United States Patent [19]

Fiske

[11] 3,993,329

[45] Nov. 23, 1976

[54] CHECK LOCATOR

[76] Inventor: Charles C. Fiske, 3639 San Remo Drive, Santa Barbara, Calif. 93105

[22] Filed: July 14, 1975

[21] Appl. No.: 595,627

[52] U.S. Cl. ..... 282/29 B
[51] Int. Cl.[2] ..... B41L 3/06
[58] Field of Search ..... 282/29 R, 29 A, 29 B, 282/8 A, 24 B, 24 R

[56] References Cited

UNITED STATES PATENTS

| | | | |
|---|---|---|---|
| 2,163,193 | 6/1939 | Critchfield | 282/29 B |
| 2,638,360 | 5/1953 | Stralis | 282/29 B |
| 2,681,237 | 6/1954 | Brodtmann | 282/29 B |
| 2,722,436 | 11/1955 | Pfeiffer | 282/29 B |
| 2,793,882 | 5/1957 | Keck | 282/29 R |
| 2,836,433 | 5/1958 | Dolan | 282/29 B |
| 2,952,478 | 9/1960 | Lortie | 282/29 B |

FOREIGN PATENTS OR APPLICATIONS

| | | | |
|---|---|---|---|
| 813,831 | 3/1937 | France | 282/29 A |

*Primary Examiner*—Jerome Schnall
*Attorney, Agent, or Firm*—Roger B. Webster

[57] ABSTRACT

A check locator for a peg-board type bookkeeping system which includes a baseboard, a row of upstanding pegs adjacent but spaced from and parallel to one edge of the baseboard, and a horizontally lined, vertically columnized journal sheet on the baseboard, such sheet having a row of perforations through which the row of pegs projects in sheet-positioning relation; the check locator comprising a slide embracing and manually movable along such edge of the baseboard, and a check-positioning member mounted in connection with the slide and overhanging the journal sheet so that—by slide motion—a check can be disposed in a selected position with a line thereof registering with a predetermined line of the journal sheet; the check being carbonized on the back whereby data written on said line of the check is carbon-copied onto such line of the journal sheet.

6 Claims, 6 Drawing Figures

FIG-4
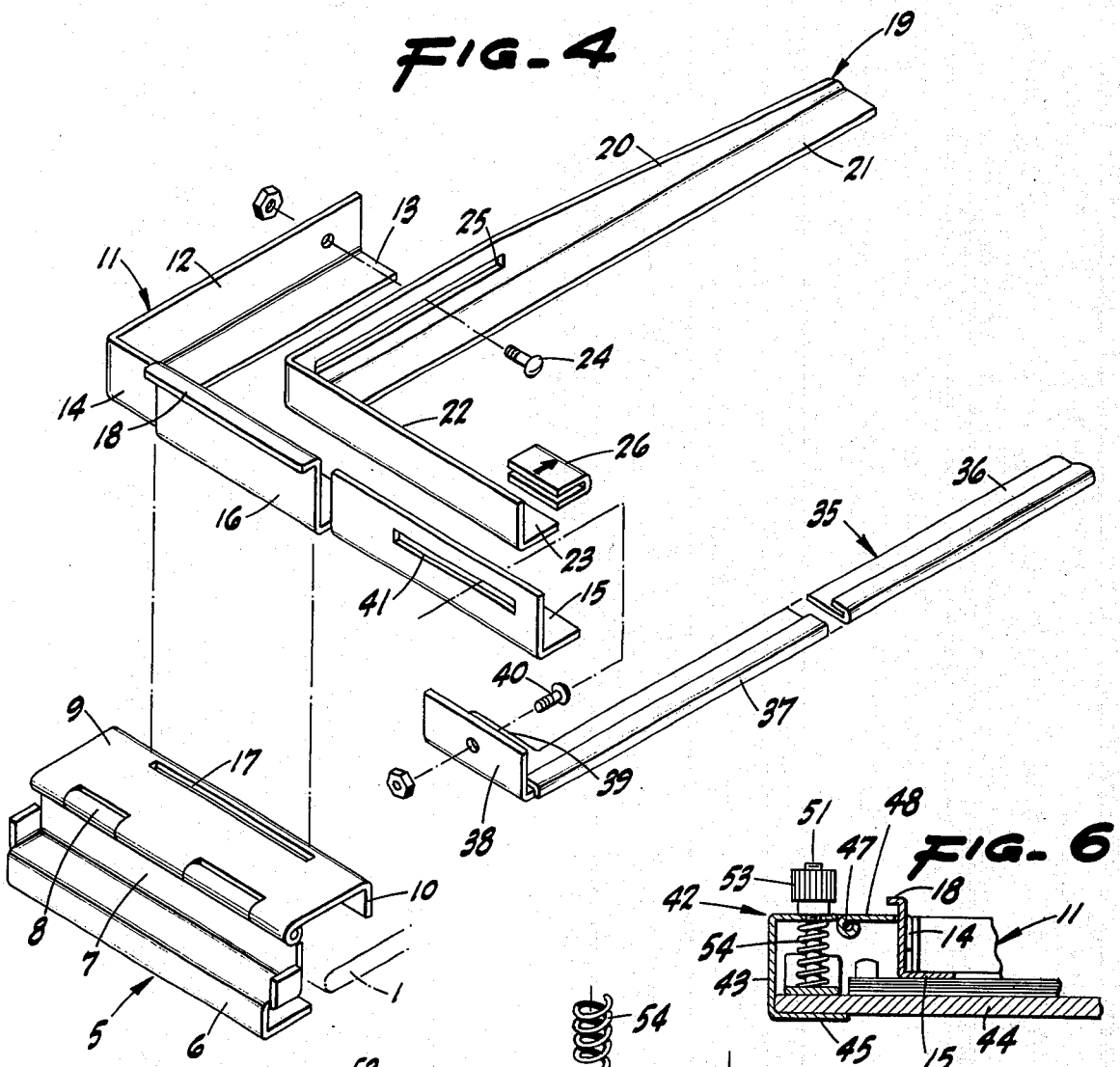
FIG-6
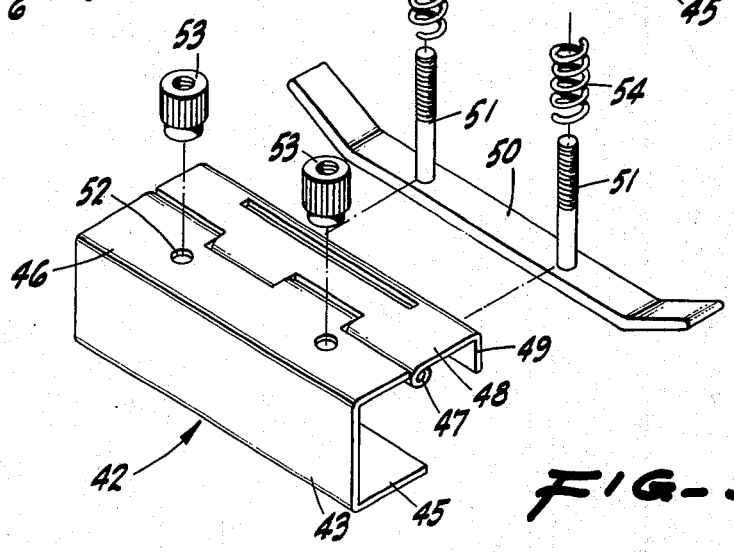
FIG-5

CHECK LOCATOR

BACKGROUND OF THE INVENTION

In many common forms of peg-board bookkeeping systems the checks, as well as the journal sheets, are perforated for reception of and proper positioning by the row of pegs. As a consequence, conventional, non-perforated checks cannot be used with such a system. This, then, presents a practical as well as an economical problem in that only one kind of check must be sought and purchased for use with the system, and at a cost in excess of conventional non-perforated checks. The present invention was conceived by me in a successful effort to overcome such problem.

SUMMARY OF THE INVENTION

The present invention provides, as a major object, a check locator—adapted for use with a peg-board bookkeeping system of the type described—which avoids the need of perforated checks, and conventional, non-perforated checks can be effectively used with the system; the check locator—which is manually operated—serving to readily and quickly register each check with a selected line of the journal sheet.

The present invention provides, as another important object, a check locator for a peg-board type bookkeeping system which includes a baseboard, a row of upstanding pegs adjacent but spaced from and parallel to one edge of the baseboard, and a horizontally lined, vertically columnized journal sheet on the baseboard, such sheet having a row of perforations through which the row of pegs projects in sheet-positioning relation; the check locator comprising a slide embracing and manually movable along such edge of the baseboard, and a check-positioning member mounted in connection with the slide and overhanging the journal sheet so that—by slide motion—a check can be disposed in a selected position with a line thereof registering with a predetermined line of the journal sheet; the check being carbonized on the back whereby data written on said line of the check is carbon-copied onto such line of the journal sheet.

The present invention provides, as a still further important object, a check locator which is of simple construction, readily and economically manufactured, and very convenient to use; the check locator being adjustable to accommodate conventional, non-perforated checks of different sizes and types.

The present invention provides, as a still further object, a practical, reliable, and durable check locator, and one which is exceedingly effective for the purpose for which it is designed.

BRIEF DESCRIPTION OF THE DRAWINGS

FIG. 4 is an exploded perspective view of the check locator.

FIG. 5 is a fragmentary perspective view showing, detached and exploded, a modified form of the slide adapted to accommodate baseboards of different thicknesses.

FIG. 6 is a fragmentary, transverse sectional view of the slide shown in FIG. 5; the view illustrating use of such slide when the baseboard is relatively thick.

DESCRIPTION OF THE PREFERRED EMBODIMENT

Figure 1:
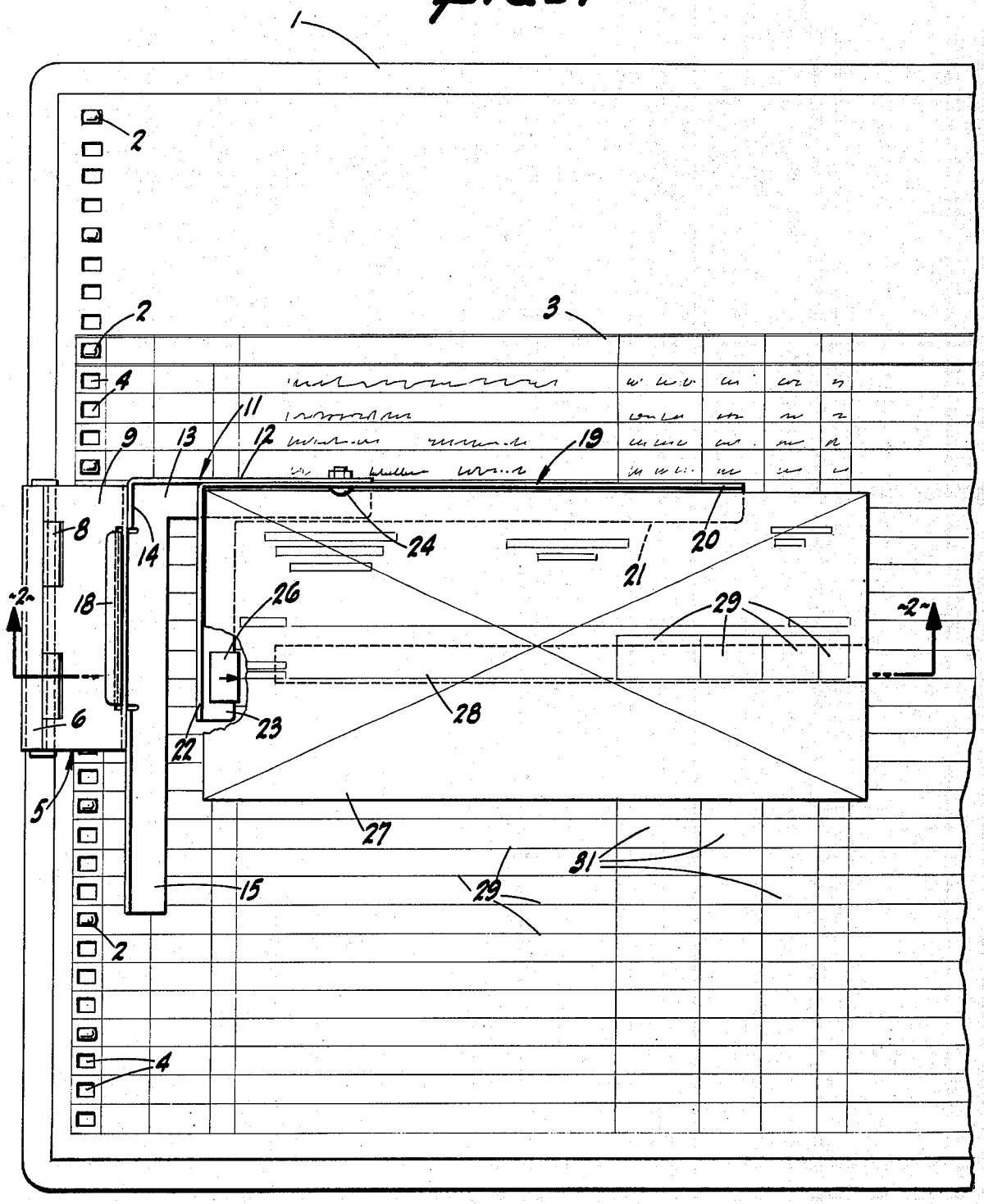
FIG. 1 is a plan view showing the check locator as in use positioning a non-perforated "center line" check on a journal sheet of a peg-board bookkeeping system.
Figure 2:
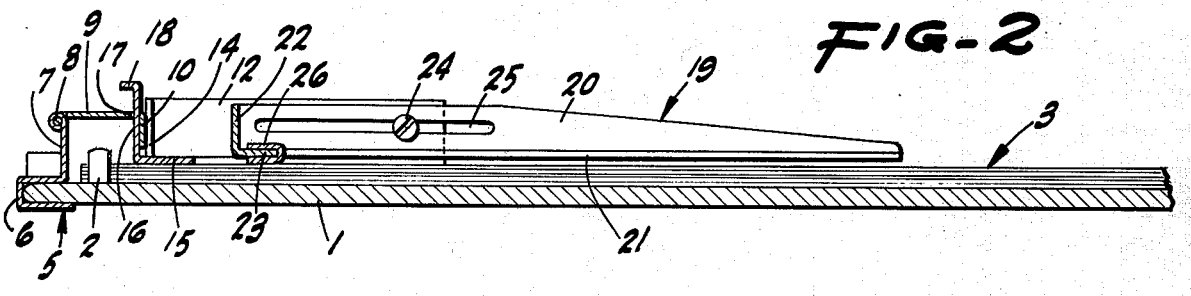
FIG. 2 is a transverse sectional elevation on line 2—2 of FIG. 1.
Figure 3:
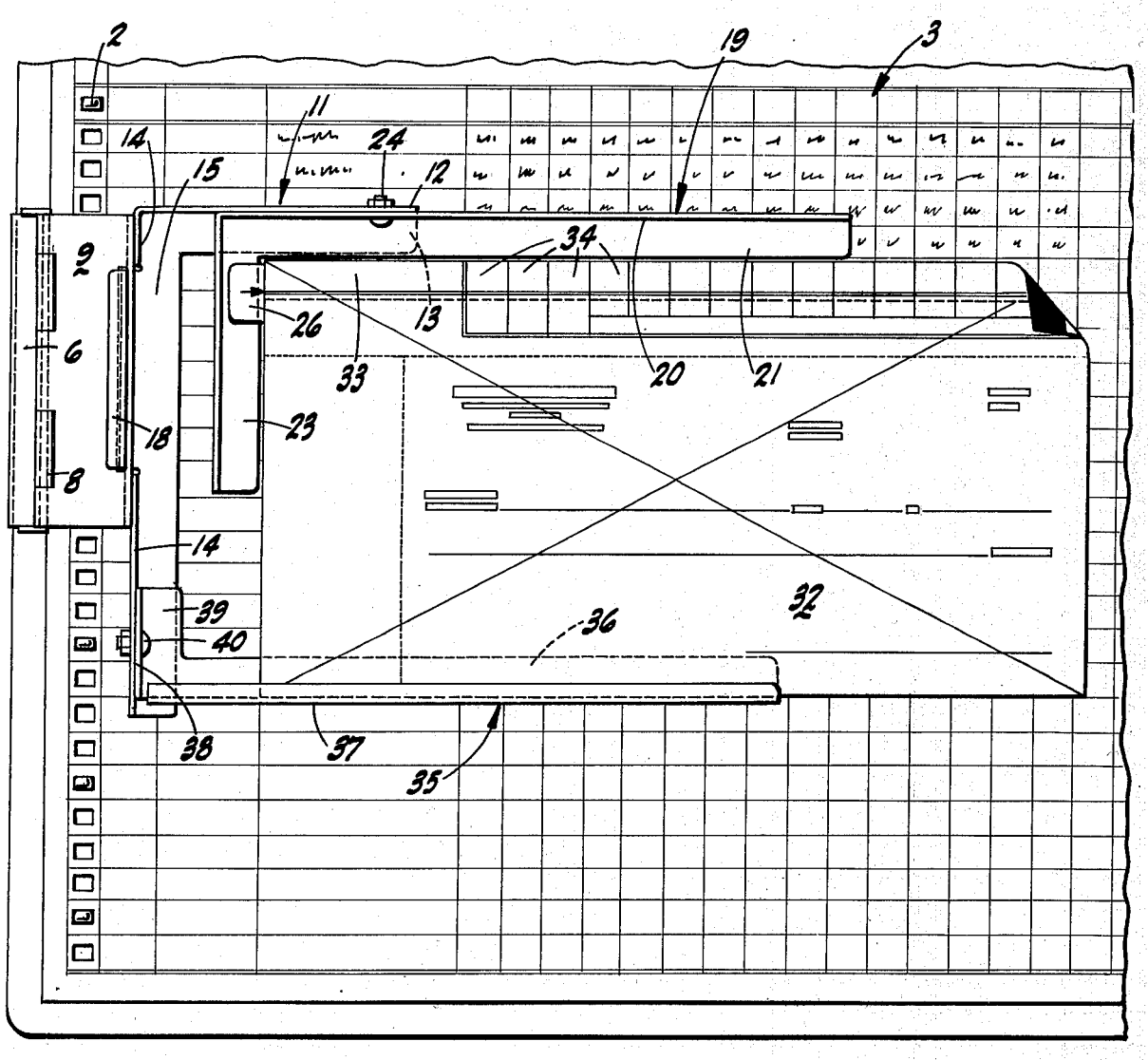
FIG. 3 is a plan view similar to FIG. 1, but shows the check locator as assembled with additional parts for use in positioning a conventional, non-perforated "top line" check on a journal sheet of a peg-board bookkeeping system.

Referring now more particularly to the drawings and to the characters of reference marked thereon—and at present to FIGS. 1 – 4, inclusive—the check locator of the present invention is adapted for use in association with a peg-board bookkeeping system which includes a baseboard 1 having a vertical row of upstanding pegs 2 thereon adjacent but spaced from, and parallel to, one edge of such baseboard 1. A horizontally lined, vertically columnized journal sheet 3 is disposed on the baseboard 1 and is formed with a row of perforations 4 which maintain such sheet 3 (or a plurality thereof) in a symmetrical position on the baseboard.

The check locator comprises a slide, indicated generally at 5, which engages and is manually shiftable along the vertical edge of baseboard 1 adjacent the row of pegs 2. More particularly, the slide 5 comprises an inwardly opening channel 6—with finger tabs at the ends as shown—which engages over and is manually slidable along the aforesaid edge of the baseboard. The channel 6 is formed at its upper, inner edge with an upstanding flange 7 hinge-connected at the upper edge, as at 8, to the adjacent edge of a normally laterally inwardly extending top plate 9; the flange 7 and top plate 9 being full length relative to the channel 6. At its free or laterally inward edge, the top plate includes a depending lip 10. As is apparent, the flange 7 upstands laterally outwardly of the row of pegs 2, while the top plate 9 spans in spaced relation above or bridges said row of pegs whereby the slide 5 is movable on the baseboard 1 without obstruction by said pegs 2.

A horizontal, inverted L-shaped or right angle bracket, indicated generally at 11, is disposed laterally inwardly of the top plate 9 and is comprised of a relatively short, upstanding longitudinal flange 12 having a bottom flange 13 and a longer, upstanding, transverse flange 14 having a bottom flange 15. Intermediate its ends, the upstanding flange 14 of the right angle bracket 11 is formed with an integral upstanding tongue 16 offset from flange 14 in the direction of top plate 9; such tongue projecting upwardly through a slot 17 in said top plate and thereabove being formed at the upper edge with a stop lip 18. Thus, while tongue 16 can move up and down in slot 17, the lip 18 prevents accidental escape of said tongue from such slot.

A horizontal, inverted L-shaped or right angle, check-positioning member, indicated generally at 19, is disposed symmetrically relative to the bracket 11; said check-positioning member 19 comprising a relatively long, upstanding, longitudinal flange 20 having a bottom flange 21, and an upstanding transverse flange 22 having a bottom flange 23. The check-positioning member 19 rests on and is supported by the bottom flange 13 of bracket 11, and is longitudinally adjustably secured thereto by a bolt 24 which adjustably clamps flange 12 to flange 20—the latter flange having a longitudinal slot 25 through which the bolt passes. The slot 25, upon loosening of bolt 24, permits adjustment of member 19.

A clip 26, having an arrow on the face thereof as a pointer, adjustably engages over the bottom flange 23; such clip being adjusted to a predetermined position before the check locator is placed in use.

For use of the check locator with a so-called "center line" type check 27 having a "payee" line 28 and—on the same line—a row of boxes 29 for data entries, the check 27 is placed in the right angle check-positioning member 19 with the upper left hand corner matchingly engaged in the corresponding corner of such member 19 and with the check 27 resting on bottom flanges 21 and 23.

The clip 26 is pre-adjusted so that when the arrow on the clip is aligned—by motion of slide 5—with the next line for use on the journal sheet 3, the check—as engaged on member 19 also pre-adjusted as to length—is disposed so that the center line 28 and the same-line boxes 29 of said check are positioned in register, respectively, with the related horizontal line 30 of the journal sheet and the corresponding boxes 31 of the vertical columns thereof. Thus, when the check 27—carbonized on the back—is prepared by manual entries on line 28 and in boxes 29, such entries are carbon-copied onto the proper line and into the proper boxes of the journal sheet. With appropriate adjustment of slide 5 on baseboard 1, this procedure is repeated line-for-line downwardly on the journal sheet as successive "center line" checks are drawn.

When it is desired to add or remove a journal sheet on the baseboard 1, the check locator unit comprised of the check-positioning member 19, bracket 11, and top plate 9, is manually swung upwardly to an out-of-the-way position whereby the row of pegs is then wholly unobstructed for placement or removal of a journal sheet. Thereafter, when such check locator unit is swung back to working position, the check-positioning member 19 comes to rest flush on the journal sheet; this for the reason that any resultant increase or decrease in the total thickness of journal sheets on the baseboard is compensated for by the upstanding tongue 16 which floats in the slot 17.

For use of the check locator with a so-called "top line" type check 32 having, on a tear-off strip at the top, a "payee" line 33 and an alined row of boxes 34 for data entries, the locator is assembled (see FIGS. 3 and 4) with additional parts as follows:

A horizontal, L-shaped or right angle check-positioning member, indicated generally at 35, projects inwardly from the lower portion of upstanding flange 14; such member 35 including a longitudinal bottom flange 36 formed with an upwardly opening trough 37, while at its inner end said member includes a short, upstanding, transverse flange 38 having a bottom flange 39 which rests on bottom flange 15. A securing bolt 40 extends through the flange 38 and a slot 41 in the adjacent portion of upstanding flange 14; such bolt thus normally but adjustably attaching the check-positioning member 35 to said flange 14.

With both the "arrow" clip 26 and the check positioning member 35 first adjusted to predetermined positions, proper for use with a "top line" check 32, and with the arrow pointing to the next-to-be-used line of the journal sheet 3, a "top line" check 32 is engaged at its lower edge in the trough 37 and in a proper longitudinal position.

Thereafter, when the "top line" portion of the check 32—which is carbonized on the back—is prepared by manual entries on line 33 and in boxes 34, such entries are carbon-copied onto the proper line and into proper boxes of the journal sheet.

With appropriate adjustment of slide 5 on baseboard 1, this procedure is repeated line-for-line downwardly on the journal sheet as successive "top line" checks are drawn.

In FIGS. 5 and 6 there is disclosed a modified form of the slide here indicated generally at 42—adapted to accommodate baseboards of different thicknesses. In this embodiment, the slide 42 comprises an inwardly opening channel 43 having a vertical depth much greater than any baseboard 44 upon which the check locator is adapted to be used.

The channel 43 includes a bottom flange 45 and a top flange 46; the top flange 46 being hinge-connected at its laterally inner edge, as at 47, to the adjacent edge of a normally laterally inwardly extending top plate 48 having a depending, free-edge lip 49.

The top plate 48 carries the same parts and serves the same purpose as the top plate 9 of FIGS. 1 – 4, inclusive; such parts including, by like reference numeral, the bracket 11.

A longitudinal presser bar 5—with upturned ends—is disposed within the confines of channel 43, and such bar includes upstanding, longitudinally spaced, threaded studs 51 which slidably engage through holes 52 in top flange 46; there being finger nuts 52 on such studs above said flange 46. Compression springs 54 surround the studs 51 in engagement between the top flange 46 and the presser bar 50—the springs normally urging said bar downwardly.

In use of the check locator with the slide 42, of FIGS. 5 and 6, the channel 43 is fully engaged over the baseboard 44 from one edge thereof; the baseboard then resting on the bottom flange 45. Nextly, the presser bar 50—initially in a raised position—is adjusted downwardly (by manipulation of nuts 53) until said bar rests in spring-pressed but easily slidable relation on top of the adjacent portion of said baseboard 44.

In the above manner, the slide 42, of FIGS. 5 and 6, can be readily manually adjusted to accommodate baseboards of different thicknesses. Once the slide 42 is so adjusted, the check locator is used in the same fashion as described in relation to FIGS. 1 – 4, inclusive.

The term "journal sheet" as used herein is to be understood as a single sheet on the baseboard or the topmost one of a plurality of such sheets in superimposed relation on said baseboard. Further, while this specification makes reference to use of the check locator with a "journal sheet", the locator can be used effectively with other kinds of bookkeeping sheets.

From the foregoing description, it will be readily seen that there has been produced such a check locator as substantially fulfills the objects of the invention as set forth herein.

While this specification sets forth in detail the present and preferred construction of the check locator, still in practice such deviations from such detail may be resorted to as do not form a departure from the spirit of the invention as defined by the appended claims.

I claim:

1. A device—for locating a check in superposed, selectively positionally disposed relation to a lined, normally stationary bookkeeping sheet of a bookkeeping system which embodies a baseboard, and means for holding a bookkeeping sheet normally stationary on said baseboard—including a slide embracing and movable along one edge of the baseboard, a check-positioning member, means on said member for supporting checks with major portions of said checks overlying the bookkeeping sheet, and means mounting the check-positioning member in connection with the slide and projecting over the bookkeeping sheet so that by slide motion said check-positioning member can be disposed to position a check, of data-transfer type, with a predetermined line thereof in register with a selected line of the bookkeeping sheet; characterized by said mounting means including a plate, a hinge between said slide and said plate which permits of arcuate swinging of the check-positioning member upwardly from the bookkeeping sheet, said plate extending inwardly from the slide to normally overlie said baseboard, and a base tongue and slot connection inwardly of and separate from the hinge between said plate and said check positioning member which permits of independent, vertical floating motion of said check-positioning member substantially parallel to said baseboard.

2. A device, as in claim 1, in which said connection comprises a bracket having an upstanding tongue, the plate being formed with a slot, and the tongue projecting upwardly through the slot; the check-positioning member being secured to said bracket.

3. A device, as in claim 2, in which the tongue normally projects above the plate; there being a stop lip on the upper end of the tongue.

4. A device, as in claim 2, in which the plate includes, at its laterally inner edge, a depending lip; the bracket having an upstanding flange in part face-abutting such depending lip, and said tongue being another part of said flange offset in a direction for upward projection through the slot in the plate.

5. A device, as in claim 1, in which said connection includes a bracket having an upstanding flange; the check-positioning member having a corresponding upstanding flange, and elements securing said corresponding flanges together.

6. A device, as in claim 5, in which the check-positioning member includes a transverse bottom flange, and a clip engaged with and adjustable along such transverse bottom flange; the clip having a pointer thereon for alinement with a line of the bookkeeping sheet.

* * * * *